United States Patent [19]

Diener

[11] 4,018,416

[45] Apr. 19, 1977

[54] RESILIENT, DESTRUCTABLE CORE MEANS

[76] Inventor: Erhard Armin Diener, 643 Saskatchewan Crescent E., Saskatoon, Canada

[22] Filed: Nov. 14, 1975

[21] Appl. No.: 631,881

Related U.S. Application Data

[63] Continuation-in-part of Ser. No. 440,589, Feb. 7, 1974, Pat. No. 3,921,953.

[52] U.S. Cl. ..... 249/62; 249/177; 249/184

[51] Int. Cl.[2] ..... B28B 7/30; B28B 7/34

[58] Field of Search ..... 249/61–63, 249/177–178, 180, 183–184; 425/DIG. 12; 264/317, DIG. 44; 254/10.5, 51

[56] References Cited

UNITED STATES PATENTS

| | | | |
|---|---|---|---|
| 1,951,953 | 3/1934 | Tollonitsch | 254/10.5 |
| 2,234,784 | 3/1941 | Stolz | 249/183 |
| 2,589,177 | 3/1952 | Wilhelm | 249/62 |
| 2,665,109 | 1/1954 | Romby | 254/10.5 |
| 2,968,855 | 1/1961 | Stolz | 249/177 |

*Primary Examiner*—Francis S. Husar
*Assistant Examiner*—John McQuade
*Attorney, Agent, or Firm*—Stanley G. Ade

[57] ABSTRACT

This is a device for forming vents or bores in concrete walls or floors. Basically, it consists of a sleeve containing a semi-rigid thermoplastic material or the like and means incorporated therein which, when ignited, either melt or burn out the core. These are inserted within the forms or on the floor surface prior to the pouring of concrete or the like and may remain in place in the finished wall or floor until they are required. The core includes a pair of semi-rigid thermoplastic sections urged outwardly from one another by a spring so that they engage the wall forms. The preferred embodiment includes ratchetted wall form engaging strips secured between each end cap and a detachable tool for urging the strips outwardly thus forcing or jacking the end caps into engagement with the wall forms when the spring is not strong enough for this purpose.

6 Claims, 15 Drawing Figures

RESILIENT, DESTRUCTABLE CORE MEANS

BACKGROUND OF THE INVENTION

This invention is a continuation-in-part application of Ser. No. 440,589 dated Feb. 7, 1974, now U.S. Pat. No. 3,921,953, and relates to new and useful improvements in the formation of holes or vents in concrete floors or walls.

Normally, a metal sleeve or the like is installed prior to the pouring of concrete which is then removed when the concrete has set. Alternatively, the concrete has to be drilled in order to form the hole through which various pipes, conduits and the like are required to pass. Such conduits may include dryer vents, bathroom vents, air intakes, venting openings, water, gas and electrical conduits and the like.

The present methods suffer from several disadvantages. Obviously when concrete has to be drilled after it has set, considerable time and effort is required. Furthermore, it is difficult to form an aperture through a concrete wall which is of the correct dimension and which is provided with relatively smooth sides. This means that the wall has to be patched and filled after the conduit or the like has been extended through the concrete wall or floor.

The metal sleeve also suffers from several disadvantages inasmuch as it is usually relatively thin walled which wall is easily distorted during the pouring of the concrete. Furthermore, when the walls and or floor are poured, it is not always known exactly where such vents are required and furthermore, if they are not required immediately, they have to be temporarily filled or sealed in order to preserve the integrity of the wall or floor.

SUMMARY OF THE INVENTION

The present invention overcomes these disadvantages by providing a core form device which, in the case of walls, may be placed between the forms prior to the pouring of concrete and which, in the case of floors, may be placed in the desired location prior to the pouring of the concrete floor.

Once the concrete has been set and forms are removed, the device may be fired immediately or may be left until it is desired to form a hole or vent through the concrete wall. If the vent is not required at the present time, the device completely seals the wall and may be left until it is desired to utilize such a hole or bore within the wall or floor.

The device includes a semi-rigid core of a cellular thermoplastic material together with an ignition cord or the like embedded therein which, when fired, either melts or partially burns the core so that the aperture or bore is easily cleared out and ready to receive the conduit or sleeve which will pass through the wall.

The principal object and essence of the invention is therefore to provide a device of the character herewithin described which can be inserted within the wall forms or placed upon the floor supporting surface whereupon concrete or the like can be poured therearound to embed the device therein. In the wall embodiment, the ends of the device are then flush with the outer surfaces of the concrete once the forms are removed and with the floor device, the upper surface is just below the surface of the concrete floor and this particular device includes an upstanding indicator device so that it can readily be located when desired.

Another object of the invention is to provide a device of the character herewithin described which, when used between concrete forms, is compressible in length within limits to facilitate the engagement thereof between the forms. Furthermore, the ends include friction grip means which will engage the wood forms and locate the device in the desired position and maintain same in this position during the pouring of the concrete or the like therein between the forms.

Another object of the invention is to provide a device of the character herewithin described, one embodiment of which permits the pipe to be inserted through the device and to be sealed therein once it has been so inserted.

A further object of the invention includes means to jack the ends of the device outwardly when situated between a pair of wall forms, to firmly engage the device between the wall forms.

Summarizing, a device is provided which enables holes or bores of any diameter within reason, to be formed in concrete walls or floors after the pouring thereof and after the walls have hardened and the forms have been removed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DETAILED DESCRIPTION

Figure 10:
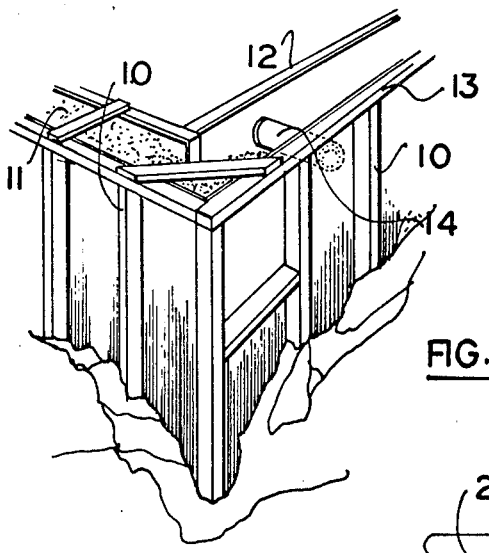
FIG. 10 is a fragmentary isometric view of a concrete wall form showing one of the devices inserted therebetween.
Figure 12:
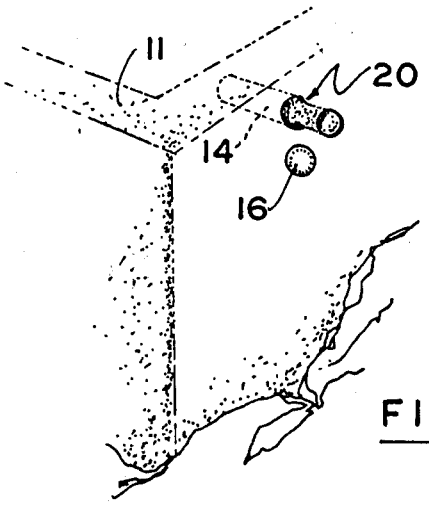
FIG. 12 is a fragmentary isometric view of a formed concrete wall with the device in use therein.

Proceeding therefore to describe the invention in detail, reference should first be made to FIG. 10 which illustrates a portion of a concrete form structure 10 for forming concrete walls 11 and it will be noted that the form structure 10 includes an inner form 12 and an outer form 13 maintained in spaced and parallel relationship one with the other. Concrete or the like is poured between these forms and when the concrete hardens, the forms are stripped off thus leaving the concrete walls 11 as clearly shown in FIG. 12.

Figure 1:
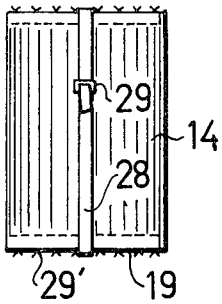
FIG. 1 is a side elevation of one embodiment of the device in the fully compressed condition.
Figure 2:
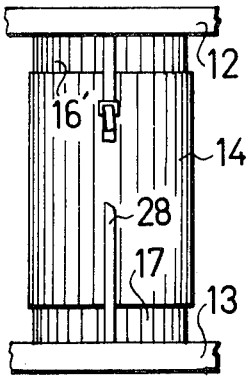
FIG. 2 is a view similar to FIG. 1, but showing same between two forms and in the expanded position.
Figure 3:
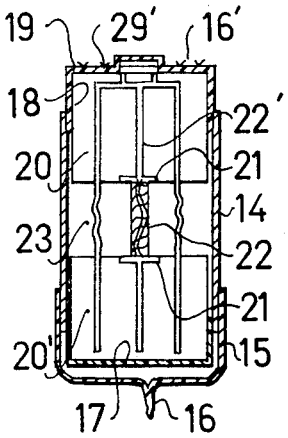
FIG. 3 is a longitudinal cross-sectional view of FIG. 2.

When it is desired to provide apertures or vent means through these walls, the device of the present invention is utilized and dealing first with the embodiment illustrated in FIGS. 1, 2 and 3, the device includes a cylindrical sleeve 14 made of plastic, cardboard or the like and being surrounded by a flexible plastic wrap 15 which is twisted at the ends 16 to enclose the device and to prevent moisture from entering therein.

Sliding end caps 16' and 17 are provided, said end caps including an annular flange portion 18 and a circular end disc portion 19. The annular flange portions are slidably engaged within the ends of the cylindrical sleeve 14.

Situated within the sleeve 14 and in a slidable relationship therewithin, is a pair of core portions 20 and 20'. Each of these portions is cylindrical having a diameter similar to the diameter of the inside of the sleeve 14. They are formed preferably from a semi-rigid material such as a thermoplastic such as styrofoam or the like, said plastic having the capability of melting under heat and partially burning.

Any form of plastic which satisfies these physical conditions can be used and each portion 20 is provided with a reinforcing disc 21 situated concentrically within the inner ends of the portions.

A compression spring 22 extends between the reinforcing discs 21 and normally biasses the portions away from one another and against the end caps 16' and 17.

Means to ignite the plastic are provided and in this embodiment take the form of ignitor cords 22' which are embedded throughout the plastic cores 20 and 20' and extend substantially from one end to the other. It will be noted that these ignitor cords also span the area 23 between the inner surfaces of the two portions 20 and 20'.

These cords are commercially available and have the capacity of burning without oxygen, the necessary oxygen being provided within the composition of the cords.

Figure 4:
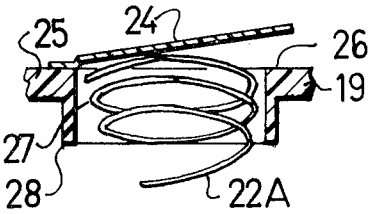
FIG. 4 is an enlarged fragmentary cross sectional view of the upper cover portion of FIG. 3.

Situated concentrically on the end caps 16' is a detachable cover portion 24 and one embodiment of such cover portion is shown in FIG. 4. A plastic disc is sealed at one side thereof as indicated at 25 and is snap engaged upon a projection 26 extending upwardly from the circular disc 19.

This circular disc is apertured underneath the cover portion 24, said apertured being indicated by reference character 27 and a relatively small cylindrical sleeve 28 is formed around this apertured internally of a cover portion 16'. Means to ignite the cord 22' are provided and, in this embodiment, take the form of an extending portion 22A of the ignitor cord which is coiled loosely within the space below the cover 24 so that disengagement of the cover permits access to this portion which can be used to ignite the ignitor cord.

Means are provided to maintain the portions 20 and 20' together with the end caps 16' and 17 in the fully compressed position shown in FIG. 1 until ready for use.

A flexible strap assembly 28 extends around the sleeve and over both end caps 16' and 17. The device is compressed manually and the strap is tightened by the buckle assembly 29.

In use, the device is positioned between the forms 12 and 13 manually, whereupon the strap assembly is severed or cut. This permits spring 22 to move the two core portions 20 and 20' away from one another and to urge the end caps 16' and 17 outwardly relative to the sleeve 14 so that they engage the inner surfaces of the forms 12 and 13 as clearly shown in FIG. 2. Small pointed projections 29' may be formed on the outer surface of the end caps 16' and 17 to assist in frictionally maintaining the device in the desired position between the forms 12 and 13 and to reinforce the frictional engagement caused by spring 22.

The concrete or the like is poured between the forms and allowed to set whereupon the forms are peeled away and the device is embedded within the concrete with the circular discs 19 of the end caps being flush with the outer surfaces of the concrete walls 11.

When it is desired to form the vent through the concrete wall, the flexible plastic wrap 15 covering the end cap or cover 24 is broken and the cover 24 is removed thus exposing the portion of the ignitor cord 22A. This is ignited and after burning has taken place, the cores are partially melted and charred so that they can easily be knocked out of the concrete wall as clearly shown in FIG. 12, it being understood that the end caps 16' and 17 are removed prior to knocking out the core. This leaves a completely smooth bore of the desired dimension adapted to receive the necessary conduit or vent pipe as desired.

Figure 5:
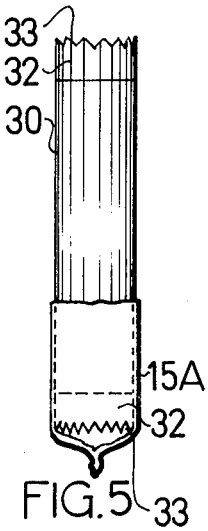
FIG. 5 is a side elevation of an alternative embodiment of the device.
Figure 6:
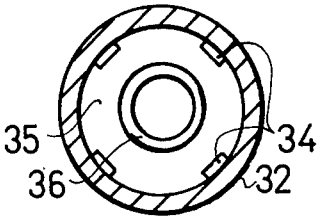
FIG. 6 is a top plan view of FIG. 5.
Figure 7:
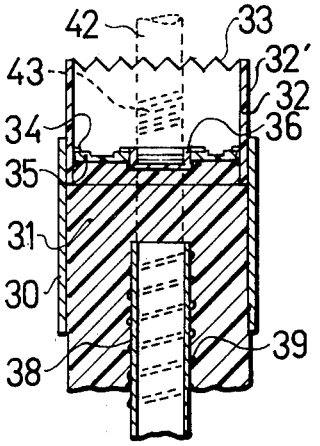
FIG. 7 is a fragmentary longitudinal sectional view of FIG. 5.

When it is desired to utilize the device for the insertion of relatively small diameter pipes such as gas, water and electricity conduits, the embodiment shown in FIGS. 5, 6 and 7 is preferred.

This embodiment includes a cylindrical sleeve 30 formed of similar material to sleeve 14 and being filled with a semi-rigid plastic material such as plastic or foam rubber indicated by reference character 31. In this embodiment, synthetic plastic is shown.

End caps or sleeves 32 are provided and take the form of relatively small cylindrical portions which are slidably engageable within the ends of the sleeve 30 and the outer edges of these sleeves are serrated as indicated by reference character 33 to act as friction engaging means within forms 12 and 13 similar to the projections 29' hereinbefore described.

The end sleeve specifically designated 32' situated at the upper end of sleeve 30 with reference to the drawings, is provided with inwardly extending projections 34 intermediate the ends thereof against which a plastic disc 35 engages from the inner end of the end sleeve 32 and the end of the foam 31 engages this disc and restrained thereby as clearly shown.

This disc is centrally apertured and a small cup-like portion 36 is frictionally engaged within this aperture with the open side of the cup facing outwardly.

The other end sleeve portion 32 is also provided with inwardly extending projections 34 and the other end of the foam engages with the projections and is restricted against outward movement by these projections.

This means that the two end portions or sleeves 32 can be compressed inwardly relative to the sleeve 30 thus compressing the foam 31 and when this pressure is released, the compressed foam will expand longitudinally thus moving the two end sleeve portions outwardly away from one another and this compressibility of the effective length of the device is used to engage this embodiment between the forms 12 and 13 with the compression of the foam 31 providing the necessary force to engage the serrated edges 33 against the inside of the foam.

Figure 11:
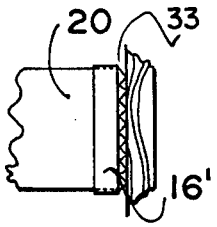
FIG. 11 is an enlarged fragmentary side elevation showing one method of friction gripping of the device against the form.

The position of the serrations relative to the forms is shown clearly in FIG. 11.

The cylindrical form 38 is embedded coaxially within the foam 31 and terminates spaced from the ends thereof as illustrated in FIG. 7 and this form is preferably hollow and manufactured from a material which is burnable.

Ignitor means taking the form of an ignitor cord 39 is spirally wound around this form and extends from one end to the other with one end extending into a relatively small cylindrical bore 40 formed in the one end of the foam as an extension to the form 38 and this extended portion 39A acts as ignitor means for the ignitor cord 39. At this end of the device, a detachable foamed plastic plug 41 engages within the portion of the end sleeve beyond the projections 34 and not only protects the ignitor cord portion 39A against the ingress of moisture or the like, but acts as a smooth outer surface to the concrete walls 11 until it is desired to form the aperture or bore through the concrete walls.

The other or upper end sleeve 32' may also be provided with a detachable foam plug similar to plug 41.

In operation of this device, the end sleeve portions 32' are manually compressed one towards the other thus compressing the foam 31 and allowing the device to be slipped between the forms 12 and 13 and to be positioned where desired. A release of this pressure enables the foam 31 to expand the end sleeves outwardly away from one another so that the serrations 33 engage the inner surfaces of the concrete wall forms 12 and 13.

After the wall has been formed and the forms have been removed, the outer surfaces of the foam plugs 41 or the equivalent are flush with the surfaces of the wall. When it is desired to form the bore through the wall, these end plugs 41 are removed and the ignitor cord portion 39A is pulled from the recess 40 and ignited. The cord is similar to that hereinbefore described and burns through the length together with the form 38.

This softens and melts the foam 31 whereupon a conduit such as a water pipe or the like indicated in phantom by reference character 42, can be pushed through. In this regard, the end of the pipe 42 is engaged within the cup 36 which protects the end particularly if the end is threaded as indicated by reference character 43. Ths pipe is pushed longitudinally through the foam which is partially melted until it extends clear through the wall and is located in the desired relationship with the wall. As the partially melted foam hardens, it seals around the pipe or conduit thus sealing it in position within the wall 11 yet still allowing slight resiliency which facilitates the attachment of further conduits upon the ends of said pipe or conduit 42. This gives a completely sealed bore through the wall and enables conduits of various sizes within limits, to be engaged therethrough.

Figure 8:
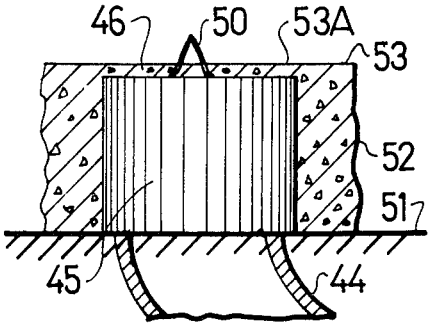
FIG. 8 is a partial cross sectional view of a concrete floor showing a further embodiment of the device situated therein.
Figure 9:
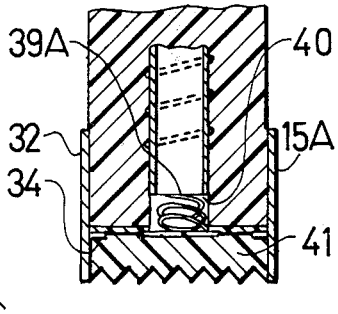
FIG. 9 is a cross sectional view of the device shown in FIG. 8.
Figure 9:
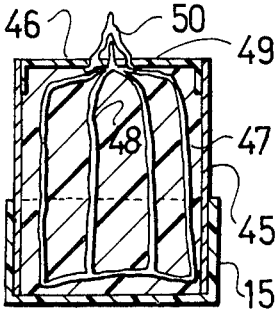

Reference should next be made to FIGS. 8 and 9 which show an embodiment of the device specifically designed for use in concrete floors wherein it may be desirable to form a bore or opening through the floor to connect, for example, with a sewer outlet 44.

The embodiment shown in FIGS. 8 and 9 includes a cylindrical sleeve 45 similar to sleeves 14 and 30 having an upper end cap 46 engageable therein. The entire device may be wrapped in flexible plastic similar to plastic 15.

A cylindrical core 47 is inserted within the sleeve 45 and is manufactured from a semi-rigid cellular thermoplastic material such as styrofoam and ignitor cords 48 are embedded within this core as illustrated in FIG. 9.

These ignitor cords terminate in a common ignitor portion 49 extending through an aperture within the cover 46.

Flexible locator means 50 may take the form of a rubber projection which is snap engaged within the aperture in the cover 46 and protects the ignitor portion 49. In use, the device is placed in the desired position upon the base 51 jupon which the floor will be poured whereupon the concrete floor 52 is poured therearound. The upper surface 53 of the concrete floor is situated just slightly above the upper surface of the cover 46 with the locator means 50 extending through the upper surface as clearly illustrated.

This enables the device to be located when it is desired to form the bore through the floor. Under these circumstances, the relatively thin film of concrete 53A is broken away and the locator 50 is pulled from the aperture within the cover 46 is removed and the partially burned and melted core 47 is cleared out thus leaving a smooth cylindrical bore through the concrete which can be used as desired.

Referring to the device illustrated in FIGS. 1 through 4, the spring 22 is normally sufficient to supply enough pressure to hold the device in position between the wall forms 12 and 13. However, under certain circumstances, a firmer engagement is required in order to prevent displacement of the device when the concrete is poured.

Figure 13:
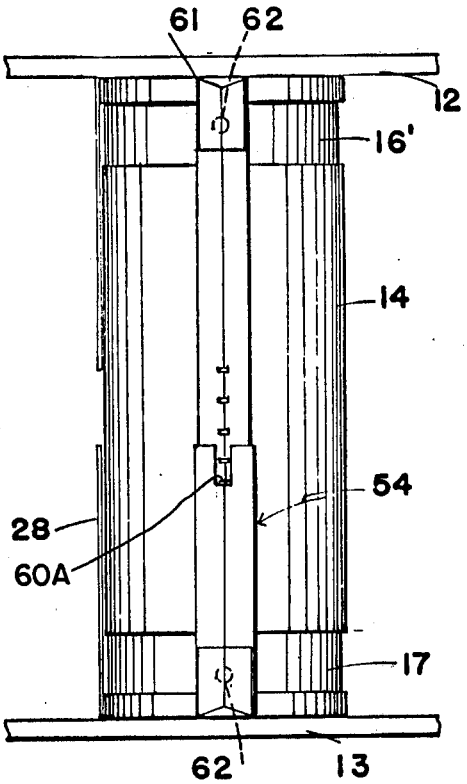
FIG. 13 is an enlarged view of an embodiment similar to FIG. 2, but showing an end cap engaging component in position.
Figure 15:
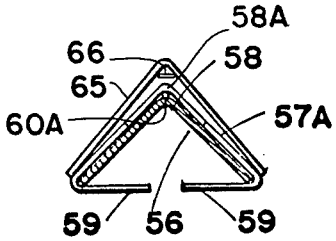
FIG. 15 is a cross sectional view of the component substantially along the line 15—15 of FIG. 14. In the drawings like characters of reference indicate corresponding parts in the different figures.
Figure 14:
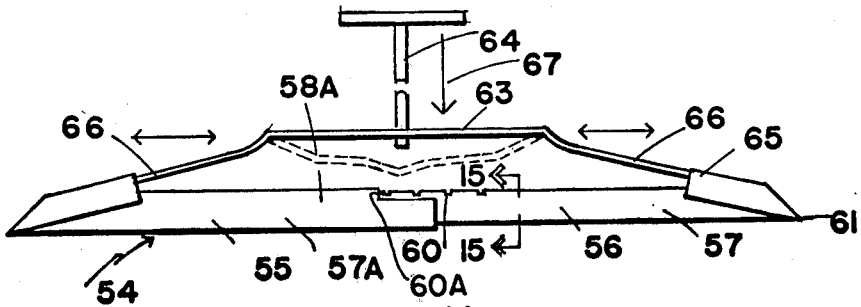
FIG. 14 is a side elevation of the end cap engaging component per se with a tool engaged therein.

In this regard, reference should be made to FIGS. 13, 14 and 15 which illustrate a component 54 provided to apply forcible pressure upon the end caps 16' and 17 and jack same outwardly into engagement with the wall forms 12 and 13.

This component 54 consists of two sections 55 and 56 which, in this embodiment, are angulated when viewed in cross section to give a substantially triangular cross section.

Section 56 includes the two sides 57 extending outwardly and downwardly from one another when viewed in cross section and terminating in the common apex 58. Section 55 also includes sides 57A which incline outwardly and downwardly from a common apex 58A and engage over the sides 57, being provided with inturned base portions 59 which retain the two sections together for longitudinal sliding movement one with the other. Means are provided to permit outward sliding movement of the two sections 55 and 56, but to prevent inward sliding movement so that the two sections are in effect ratchetted together. A plurality of notches 60 are formed on the apex 58 of the section 56 and the inner end of the apex 58A of the section 55 is bent downwardly slightly as at 60A to engage these notches for this ratchet action.

The outer ends of the sections 55 and 56 are provided with form engaging points as prongs 61 which project just beyond the extremities of the end caps 16' and 17 respectively and these two sections 55 and 56 are secured to the side walls of the end caps by means of rivets 62 or the like.

Means are provided to force the sections 55 and 56 outwardly when the device is in position between the forms and is being held frictionally by the action of spring 22 as hereinbefore described. Said means takes the form of a transversely extending, upwardly bowed spring steel strip 63 with a detachable handle component 64 extending upwardly therefrom.

Angulated portions 65 are secured to the outer ends of the sections 55 and 56 and incline inwardly and upwardly from the sections so that the outer ends 66 of the spring steel strip 63 may engage under the portions 65 and between these portions and the apices of the sections 55 and 56. Reference to FIG. 14 will show the engagement of the tool with the component 54 and it will be appreciated that downward movement of the handle 64 in the direction of arrow 67, will move the center portion of the tool 63 downwardly as shown in phantom in FIG. 14, thus forcing the ends outwardly so that the sections 55 and 56 are urged into engagement with the forms 12 and 13 thereby lodging the device firmly in position prior to the pouring of concrete. Upward movement of the handle 64 in the direction opposite to arrow 67 will disengage the tool from the component 54 which remains in position and assists in deflecting concrete around the device and absorbs the thrust of falling concrete.

It will, of course, be appreciated that the plastic strap 28 is utilized for the initial setting of the device between the forms, said strap being cut when the device is positioned and in this regard, the handle 64 and tool 63 will assist in this initial positioning.

Referring back to the embodiment shown in FIGS. 5, 6 and 7, it should also be noted that a flexible plastic cover 15A also is engaged around this sleeve 30 in a manner similar to the cover 15 in order to prevent moisture from entering the device.

The ignitor cord is preferably made from a stranded wire which encloses the ignitable material. It is available commercially under the trade mark "THERMO-LITE IGNITOR CORD" manufactured by Canadian Industries Limited and one example of the ignitable material is given below although, of course, other materials can be used either together or in combination which produces the desired results.

| COMPOUND CHEMICALS: | |
|---|---|
| Polysar Latex (Synthetic) | Sulphur |
| Potassium Oleate Soap | Trimene Base |
| Zinc Oxide Dispersion | Enthazate 50-D |
| Sodium Silico Fluoride | OXAF-W |
| Potassium Nitrate | Carbon |
| Monsanto Lampblack | Water |

The mixing proportions and procedures are given as follows:

| MIXING PROPORTIONS AND PROCEDURES:- | |
|---|---|
| Polysar Latex (PL728 Mix) | 26 oz. |
| Potassium Oleate Soap | 80 ml. |
| Water | 20 ml. |
| Carbon | 20 Gr. |
| Sulfur | 140 Gr. |
| Potassium Nitrate | 1300 Gr. |

-continued

| MIXING PROPORTIONS AND PROCEDURES:- | |
|---|---|
| Sodium Silico Fluoride | 60 ml. |

The procedure of mixing is as follows. Mix the Potassium Oleate Soap and water with the Polysar Latex Mix. Weigh the carbon and sulphur together and intermix well in a pestle and mortar. This carbon and sulfur is then added to the mixing bowl with the soap, water and latex and the ingredients are beaten to a fairly stiff mix.

The Potassium Nitrate is then added together with the Sodium Silico Fluoride and the remainder of the ingredients and the whole is beaten for a further 30 seconds thus giving a flexible mass which can be used and which then hardens and forms a burnable material not requiring external oxygen.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim

1. A vent forming device for walls and the like of concrete adapted to be embedded in the wall when same is poured between a pair of wall forms, comprising in combination a substantially cylindrical sleeve, a pair of cores of semi-rigid thermoplastic material one in each end of said sleeve being slidably engageable within said sleeve, wall form engaging end caps one on each outer end of said cores, means between said cores normally urging said cores apart from one another, flammable means extending through said cores which, when ignited, partially destroys said cores, and igniting means connected to said flammable means and extending from the outer end of at least one of said cores for igniting said flammable means.

2. The device according to claim 1 in which said means normally urging said cores apart includes a compression spring reacting between said cores and means on the inner ends of said cores to mount said spring.

3. The device according to claim 1 which includes means to extend said end caps and said cores away from one another thereby forcing said end caps into engagement with the associated wall forms, said last mentioned means including a rigid engaging component extending between said end caps externally of said sleeve and being secured to said end caps adjacent the ends of said component, said component comprising two sections slidably engaged together, ratchet means cooperating between said two sections preventing inward movement of said two sections relative to one another and means detachably engaged within said two sections to urge same apart whereby said end caps are forcibly engaged within the associated wall forms.

4. The device according to claim 2 which includes means to extend said end caps and said cores away from one another thereby forcing said end caps into engagement with the associated wall forms, said last mentioned means including a rigid engaging component extending between said end caps externally of said sleeve and being secured to said end caps adjacent the ends of said component, said component comprising two sections slidably engaged together, ratchet means cooperating between said two sections preventing inward movement of said two sections relative to one another and means detachably engaged within said two sections to urge same apart whereby said end caps are forcibly engaged within the associated wall forms.

5. The device according to claim 3 in which said means detachably engaged within said two sections includes a transversely extending, normally upwardly bowed spring steel member, a handle secured to said spring steel member for operating said spring steel member, and means to detachably engage the ends of said spring steel member with said component, said last mentioned means including upwardly and inwardly extending portions secured to adjacent the outer ends of said component, the ends of said spring steel member detachably engaging between said portions and said component whereby downward movement of said spring steel member forces the ends of said spring steel member outwardly thereby forcing said end caps outwardly.

6. The device according to claim 4 in which said means detachably engaged within said two sections includes a transversely extending, normally upwardly bowed spring steel member, a handle secured to said spring steel member for operating said spring steel member, and means to detachably engage the ends of said spring steel member with said component, said last mentioned means including upwardly and inwardly extending portions secured to adjacent the outer ends of said component, the ends of said spring steel member detachably engaging between said portions and said component whereby downward movement of said spring steel member forces the ends of said spring steel member outwardly thereby forcing said end caps outwardly.

* * * * *